US012408760B2

(12) United States Patent
Fisher

(10) Patent No.: US 12,408,760 B2
(45) Date of Patent: Sep. 9, 2025

(54) SYSTEM AND METHOD FOR BED WITH STORAGE AREA

(71) Applicant: Lance Fisher, Vernon (CA)

(72) Inventor: Lance Fisher, Vernon (CA)

( * ) Notice: Subject to any disclaimer, the term of this patent is extended or adjusted under 35 U.S.C. 154(b) by 170 days.

(21) Appl. No.: 18/338,146

(22) Filed: Jun. 20, 2023

(65) Prior Publication Data

US 2023/0404269 A1 Dec. 21, 2023

Related U.S. Application Data

(60) Provisional application No. 63/366,719, filed on Jun. 21, 2022.

(51) Int. Cl.

| | |
|---|---|
| ***A47C 17/52*** | (2006.01) |
| ***A47B 23/00*** | (2006.01) |
| ***A47B 81/00*** | (2006.01) |
| ***A47C 17/62*** | (2006.01) |
| ***A47C 17/86*** | (2006.01) |
| ***A47C 19/22*** | (2006.01) |

(52) U.S. Cl.

CPC ..... *A47C 17/52* (2013.01); *A47B 81/005* (2013.01); *A47C 17/62* (2013.01); *A47B 23/00* (2013.01); *A47C 17/86* (2013.01); *A47C 19/22* (2013.01)

(58) Field of Classification Search

CPC ..... A47C 17/52; A47C 17/62; A47C 17/86; A47C 19/22; A47B 81/005; A47B 23/00

USPC ..... 5/503.1, 308, 2.1, 3

See application file for complete search history.

(56) References Cited

U.S. PATENT DOCUMENTS

| | | | | | |
|---|---|---|---|---|---|
| 277,563 | A * | 5/1883 | Fuson | A47C 21/022 | 5/498 |
| 751,010 | A * | 2/1904 | Pyle | A47C 21/022 | 24/72.5 |
| 2,692,009 | A * | 10/1954 | Warshaver | A47C 19/045 | 5/58 |
| 2,895,145 | A * | 7/1959 | Soifer-Oscar | A47C 21/00 | 5/931 |
| 4,788,838 | A * | 12/1988 | Cislo | F41C 33/06 | 5/503.1 |
| 4,869,449 | A * | 9/1989 | Goodman | F41C 33/06 | 5/931 |
| 5,020,173 | A * | 6/1991 | Dreyer, Jr. | A47C 17/86 | 297/188.1 |

(Continued)

FOREIGN PATENT DOCUMENTS

CA 3204055 A1 * 12/2023 ..... A47B 81/005

OTHER PUBLICATIONS

"BedBunker Safe", Gunsafes.com, https://www.gunsafes.com/BedBunker-King-Size-BedBunker.html.

*Primary Examiner* — Robert G Santos

(74) *Attorney, Agent, or Firm* — Cherskov Flaynik & Gurda, LLC

(57) ABSTRACT

What is disclosed is a a storage area for a bed and a method of use. The bed includes a first section and a second section coupled to each other via a hinge mechanism. The first section includes a first surface, wherein one or more items of bedding lie on the first surface, and a constraining mechanism. The second section includes a storage area. The method includes rotating the first section about the hinge mechanism from a closed position to an open position and constraining, by the constraining mechanism, the one or more items of bedding to lie on the first surface during the rotating of the first section.

20 Claims, 10 Drawing Sheets

(56) References Cited

U.S. PATENT DOCUMENTS

| | | | | |
|---|---|---|---|---|
| 5,056,342 | A * | 10/1991 | Prinz | A47C 21/00 109/51 |
| 6,082,272 | A | 7/2000 | Adrain | |
| 6,292,960 | B1 | 9/2001 | Bowling | |
| 6,684,432 | B2 | 2/2004 | Owens, Jr. | |
| 6,704,952 | B2 * | 3/2004 | Kurtz | A47C 21/00 5/503.1 |
| 6,711,766 | B2 * | 3/2004 | Monk | E04C 2/405 5/722 |
| 7,137,881 | B2 * | 11/2006 | Walling | A47C 31/002 454/251 |
| 8,074,477 | B1 | 12/2011 | Weiche | |
| 9,021,840 | B2 | 5/2015 | Andrews | |
| 10,295,311 | B1 | 5/2019 | Trubacek | |
| 12,121,145 | B2 * | 10/2024 | Fry | A47C 19/22 |
| 2003/0159214 | A1 * | 8/2003 | Kurtz | A47C 17/86 5/503.1 |
| 2003/0221256 | A1 * | 12/2003 | Monk | F41H 5/08 5/722 |
| 2004/0158920 | A1 * | 8/2004 | Walling | A47C 31/002 5/2.1 |
| 2023/0027599 | A1 * | 1/2023 | Fry | A47B 46/00 |
| 2023/0404269 | A1 * | 12/2023 | Fisher | A47C 17/86 |

* cited by examiner

SYSTEM AND METHOD FOR BED WITH STORAGE AREA

PRIORITY CLAIM

The instant application claims priority to U.S. provisional application 63/366,719, filed on Jun. 21, 2022, the contents of which are now incorporated by reference.

FIELD OF THE INVENTION

The present disclosure relates to storage areas for beds.

BRIEF SUMMARY

A method for a storage area for a bed, wherein the bed comprises a first section and a second section coupled to each other via a hinge mechanism, the first section comprises a first surface, wherein one or more items of bedding lie on the first surface, and a constraining mechanism, and the second section comprises a storage area, the method comprising: rotating the first section about the hinge mechanism from a closed position to an open position; and constraining, by the constraining mechanism, the one or more items of bedding to lie on the first surface during the rotating of the first section.

In some embodiments, the constraining mechanism comprises one or more headboards comprising a first one or more panels, wherein the first one or more panels rotate between a first head position and a second head position, and one or more footboards comprising a second one or more panels, wherein the second one or more panels rotate between a first foot position and a second foot position; the constraining further comprising the first one or more panels rotating from the first head position to the second head position, the second one or more panels rotating from the first foot position to the second foot position, and the rotating of the first one or more panels and the second one or more panels operative to hold the one or more items of bedding to the first surface.

In some embodiments, initiating the rotating comprises using one of a key; a keypad, keyboard or touchscreen; a combination lock; a radio frequency identification (RFID)-based technique; an application running on an input device; a voice command; a near field communications (NFC)-based technique; a pushbutton, or a magnetic sensor.

In some embodiments, the storage area stores one or more contents; and the method further comprises moving one of the one or more contents either during or after the rotating of the first section is performed.

In some embodiments, the storage area is fire resistant or fire proof.

In some embodiments, the storage area is protected using a locking mechanism; and the method further comprises unlocking the locking mechanism using one of a key, a numeric or alphanumeric combination, an RFID-based technique, an application running on an input device, a voice command, an NFC-based technique, and a biometric technique.

In some embodiments, the storage area is configured to store firearms and ammunition.

In some embodiments, the constraining is performed using one or more of: a pneumatic mechanism, a hydraulic mechanism, a linear actuator, an electric motor, a spring, a cable, or a gas spring.

In some embodiments, either the first section or the storage area comprises a lighting subsystem.

In some embodiments, the first section comprises a second surface, and one or more items are mounted to the second surface.

A system for a storage area for a bed, wherein the bed comprises a first section and a second section coupled to each other via a hinge mechanism, the first section comprises a first surface, wherein one or more items of bedding lie on the first surface, and a constraining mechanism controlled by a constraining mechanism control unit, the second section comprises a storage area, and a sectional rotating mechanism to rotate the first section about the hinge mechanism between a closed position and an open position, wherein the sectional rotating mechanism is controlled by a sectional rotating mechanism control unit, and the sectional rotating mechanism control unit is communicatively coupled to the constraining mechanism control unit via one or more interconnections, wherein when the first section is rotated to the open position from the closed position, the constraining mechanism is controlled by the constraining mechanism control unit to constrain the one or more items of bedding to lie on the first surface during the rotating of the first section.

In some embodiments, the constraining mechanism comprises one or more headboards comprising a first one or more panels, wherein the first one or more panels rotate between a first head position and a second head position, and one or more footboards comprising a second one or more panels, wherein the second one or more panels rotate between a first foot position and a second foot position; the constraining further comprising the first one or more panels rotating from the first head position to the second head position to hold the one or more items of bedding to the first surface, the second one or more panels rotating from the first foot position to the second foot position, and the rotating of the first one or more panels and the second one or more panels operative to hold the one or more items of bedding to the first surface.

In some embodiments, initiating the rotating comprises using one of a key; a keypad, keyboard or touchscreen; a combination lock; a radio frequency identification (RFID)-based technique; an application running on an input device; a voice command; a near field communications (NFC)-based technique; a pushbutton, or a magnetic sensor.

In some embodiments, the storage area stores one or more contents; and the sectional rotating mechanism control unit controls the movement of the one or more contents either during or after the rotating.

In some embodiments, the bed further comprises a ballistic shield to enable a user to take cover in a position other than a prone position.

In some embodiments, the storage area is protected using a locking mechanism controlled by a locking mechanism control unit; and the locking mechanism is unlocked by the locking mechanism control unit using one of a key, a numeric or alphanumeric combination, an RFID-based technique, an application running on an input device, a voice command, an NFC-based technique, and a biometric technique.

In some embodiments, the storage area is bullet resistant or bullet proof.

In some embodiments, the constraining mechanism comprises one or more of: a pneumatic mechanism, a hydraulic mechanism, a linear actuator, an electric motor, a spring, a cable, or a gas spring.

In some embodiments, either the first section or the storage area comprises a lighting subsystem.

In some embodiments, the first section comprises a second surface, and one or more items are mounted to the second surface.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1A:
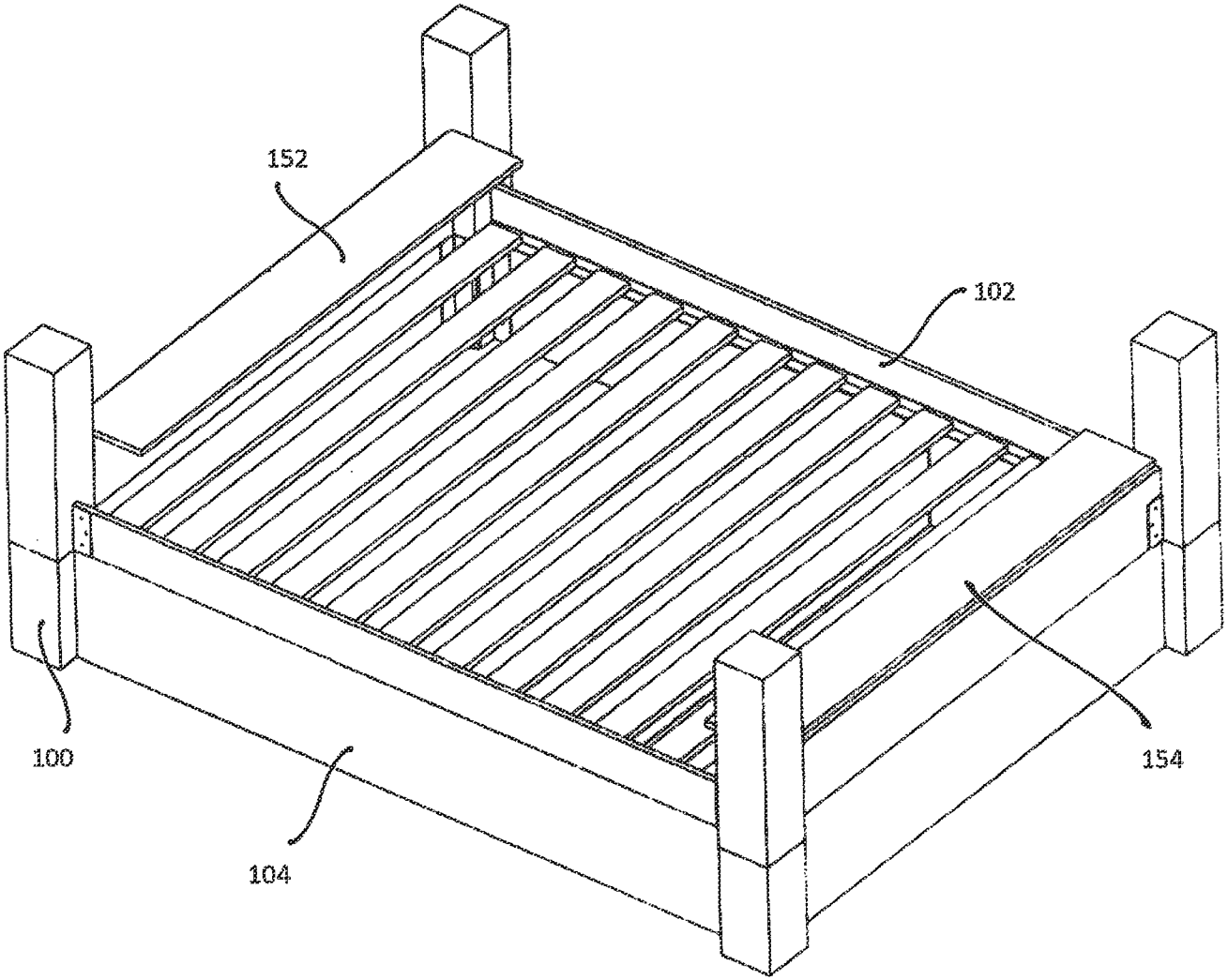
FIG. 1A illustrates an example embodiment of a bed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Previously, there have been works of prior art which describe storage areas or storage areas integrated into beds and other items of furniture. For example:

- U.S. Pat. No. 6,684,432 to Owens Jr., filed Oct. 9, 2001 and issued on Feb. 3, 2004 (hereinafter referred to as "Owens Jr.");
- U.S. Pat. No. 9,021,840 to Andrews, filed Nov. 26, 2012 and issued on May 5, 2015 (hereinafter referred to as "Andrews");
- U.S. Pat. No. 6,292,960 to Bowling, filed Mar. 21, 2000 and issued on Sep. 25, 2001 (hereinafter referred to as "Bowling"); and
- U.S. Pat. No. 8,074,477 to Weiche, filed May 29, 2008 and issued on Dec. 13, 2011 (hereinafter referred to as "Weiche");

disclose storage areas integrated into beds.

However, the systems disclosed in each of Owens Jr., Andrews, Bowling, and Weiche suffer from limitations. For example, Owens Jr. discloses a system having an opening on the side of the bed, potentially limiting the size of the storage area.

Weiche discloses a compartment which pivots away from the bed, which means that the storage area also suffers from a size limitation.

Bowling discloses a system with one or more sliding drawers integrated into the bed. However, it may not be easy for a user to access the storage area if there is insufficient space for any of the one of more sliding drawers to slide out fully, leading to inconvenience for the user. The storage area disclosed in Andrews is small and requires space to slide out as well.

A configuration which offers more storage area without the attendant issues posed by sliding drawers is one with a rotatable hinged lid, which can be opened. An example of this configuration can be found in U.S. Pat. No. 6,082,272 to Adrain (hereinafter referred to as "Adrain"). Adrain describes a storage area integrated into a bed frame with a pivotable hinged lid. Therefore, the user does not need space to slide out a drawer to access the contents of the storage area. Furthermore, this offers the possibility of a much larger storage area.

However, for a user of the system described in Adrain, the user needs to move the bedding either fully or partially off the bed before opening the lid to the storage area to access the storage area. This is inconvenient and time-consuming for the user, as the user has to:

- move items of bedding from above the storage area,
- open the door to the storage area,
- remove items from or place items into the storage area, and
- move the items of bedding back into place over the storage area.

This may be difficult if, for example, heavier or bulkier items of bedding such as mattresses are utilized.

The BEDBUNKER product by Heracles Research, (hereinafter referred to as "BEDBUNKER") shown on their website available online at https://heraclesresearch.com/bedbunker-safes/queen-bedbunker-safe/, retrieved on Jun. 17, 2023, has a similar issue.

Additionally, while the storage area in Adrain and BEDBUNKER may be bulletproof or bullet resistant, a user may be constrained to take cover behind the storage area in a prone position, that is, where the user is lying down.

There are furniture items described in the prior art which can be converted into ballistic shields, and allow for a user to take cover in a position other than a prone position, for example, sitting down, crouching, or partially standing up. For example, U.S. Pat. No. 10,295,311 to Trubacek et al, filed Nov. 27, 2018 and issued on May 21, 2019 (hereinafter referred to as "Trubacek") describes a flip-top table which can be transformed into a ballistic shield. However, there are no such beds described in the prior art. Furthermore, it is not clear how to integrate the flip-top table described in Trubacek into a bed.

Therefore, there is a need for a bed with a storage area which can:

- be accessed by a user more conveniently and easily compared to the prior art systems; and
- act a ballistic shield allowing a user to take cover in both prone positions and positions other than prone positions.

A system and method which achieves these objectives is described below and with reference to FIGS. 1A-9.

FIG. 1A shows an example embodiment of a bed 100. The bed 100 comprises a first section 102 and a second section 104 coupled to each other via a hinge mechanism, which will be detailed below. In FIG. 1A, first section 102 is in a closed position. Headboard 152 and footboard 154 form part of a constraining mechanism, the operation of which will be further detailed below.

Figure 1B:
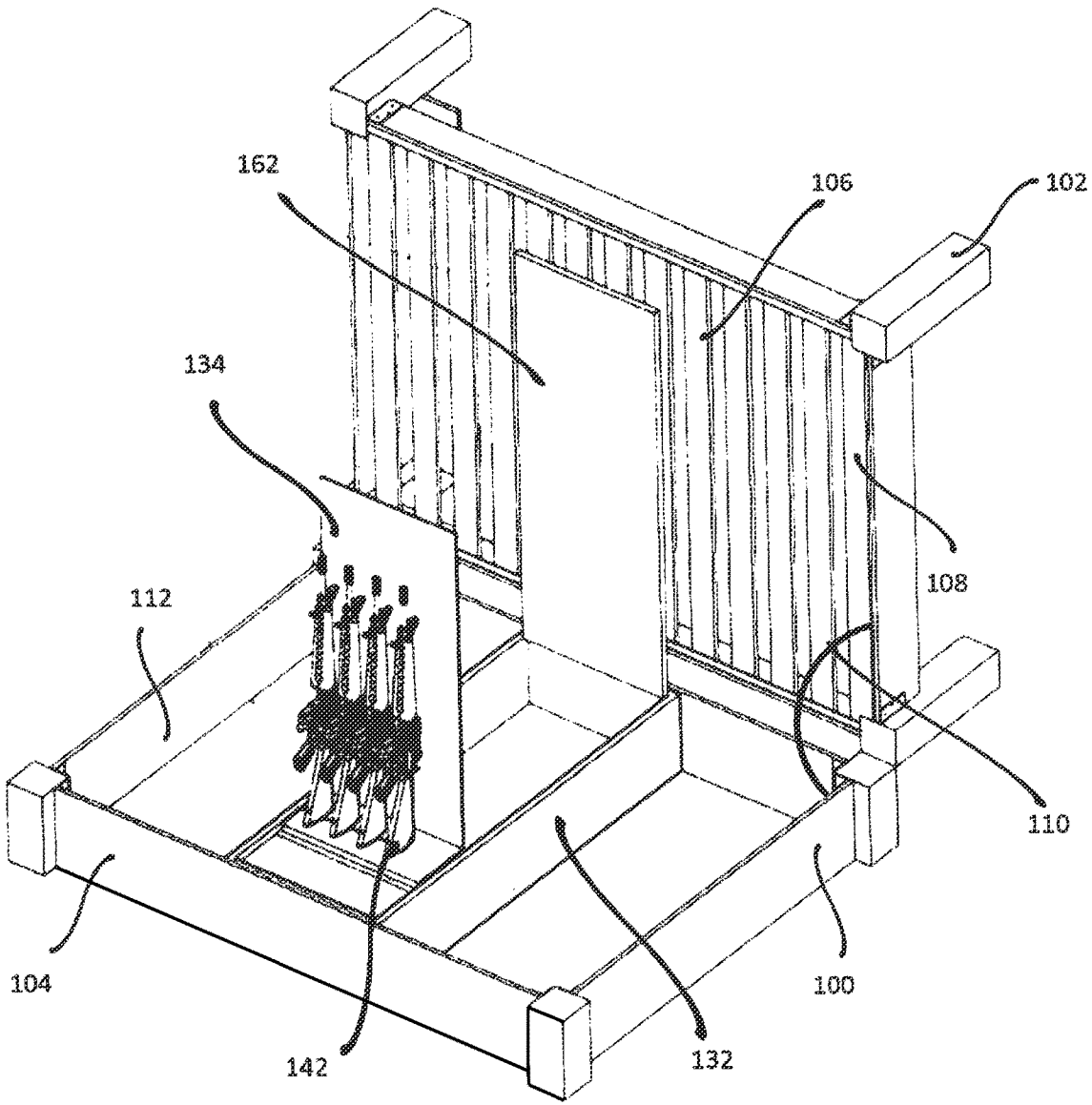
FIG. 1B illustrates an example embodiment of a bed where the first section is in an open position.
Figure 3:
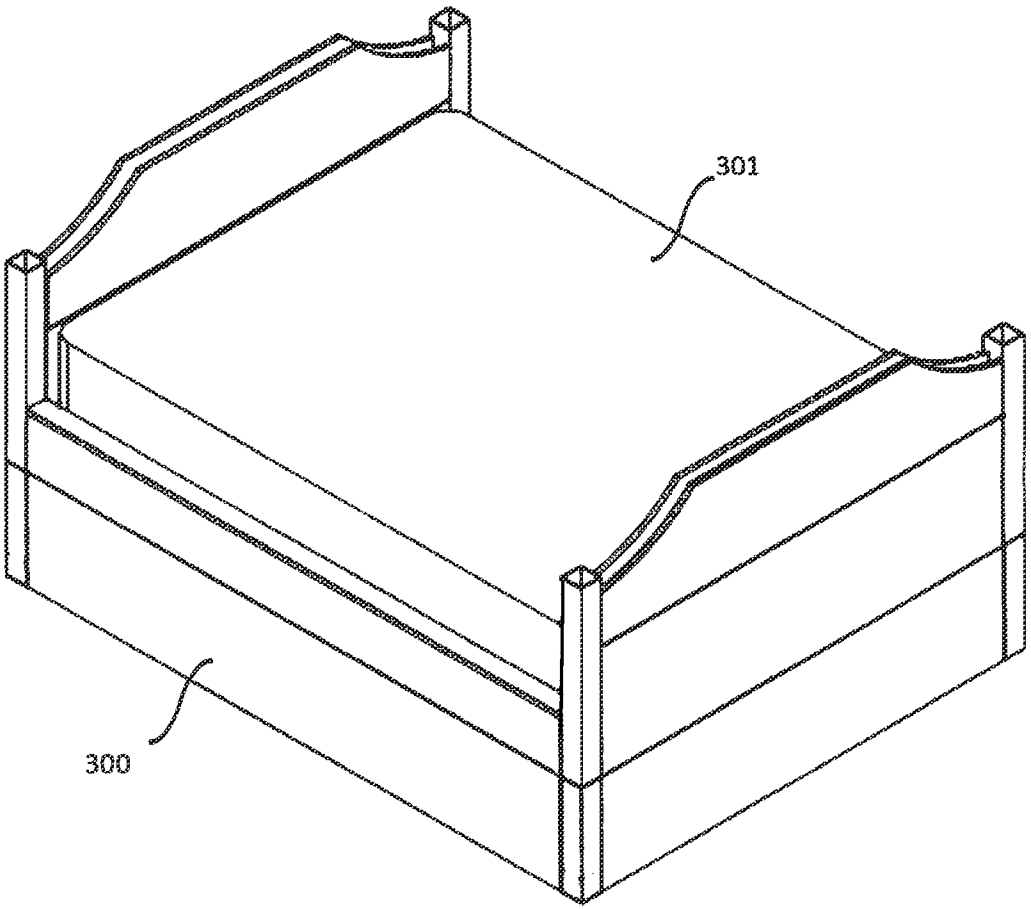
FIG. 3 illustrates an example embodiment of a bed with one or more items of bedding lying on a first surface of a first section of the bed.

FIG. 1B shows bed 100 with the first section 102 in an open position. First section 102 comprises a first or exterior facing surface 106; and a second or interior facing surface 108. The first surface 106 faces the exterior of the bed. First surface 106 is horizontal when the first section 102 is in a closed position, and one or more items of bedding lie on the first surface 106 when first section 102 is in a closed position. The one or more items of bedding comprise, for example, mattresses, blankets, pillows, bedsheets, and duvets. An example embodiment of a bed 300 with one or more items of bedding 301 lying on the first surface is shown in FIG. 3.

Second surface 108 faces the interior of the bed when first section 102 is in a closed position. The second surface 108 acts as a lid to cover the storage area, which will be described in further detail below.

The second section 104 comprises an integrated storage area 112, which stores one or more contents. For example, in some embodiments, the one or more contents comprise firearms, such as rifles 142, and ammunition. It would be known to one of skill in the art that the one or more contents are not restricted to firearms and ammunition. The one or more contents could include, for example, documents, jewelry or other items of value.

As explained above, when the first section is in the closed position, the second surface acts as a lid to cover the storage area. For example, in the example embodiment shown in FIG. 1B, second surface 108 acts as a lid to cover storage area 112.

In some embodiments, the storage area comprises one or more physical organizing elements to ensure that the one or more contents in the storage area are organized; and made available for presentation and access to a user. Examples of physical organizing elements are box 132 and mount 134 in storage area 112, as shown in FIG. 1B. One of ordinary skill in the art would know that physical organizing elements comprise, for example, mounts, boxes, shelves, holders, compartments, and other such items to ensure better organization, presentation and access by a user.

In some embodiments, at least one of the one or more contents in the storage area is moved either during or after the rotating of the first section, to ensure easier access and better presentation to a user. In some embodiments, this comprises moving one or more of the physical organizing elements. For example, in FIG. 1B, mount 134 is rotated after the rotating of the first section is performed, so as to enable easier access by a user to rifle 142. The moving is performed using one or more electro-mechanical means for example, actuators, moving shelves or other means known to those in the art.

In some embodiments, the storage area 112 is made bullet proof or bullet resistant using one or more techniques known to those of skill in the art. In some embodiments, the storage area 112 is made fire resistant or fire proof. This is achieved by, using one or more techniques known to those of skill in the art.

In FIG. 1B, second surface 108 forms an angle of rotation 110 with the second section 104. In some embodiments, when the first section is in an open position, angle 110 falls in a range between 45 and 135 degrees. The angle is set using one or more techniques known to those in the art.

Figure 2:
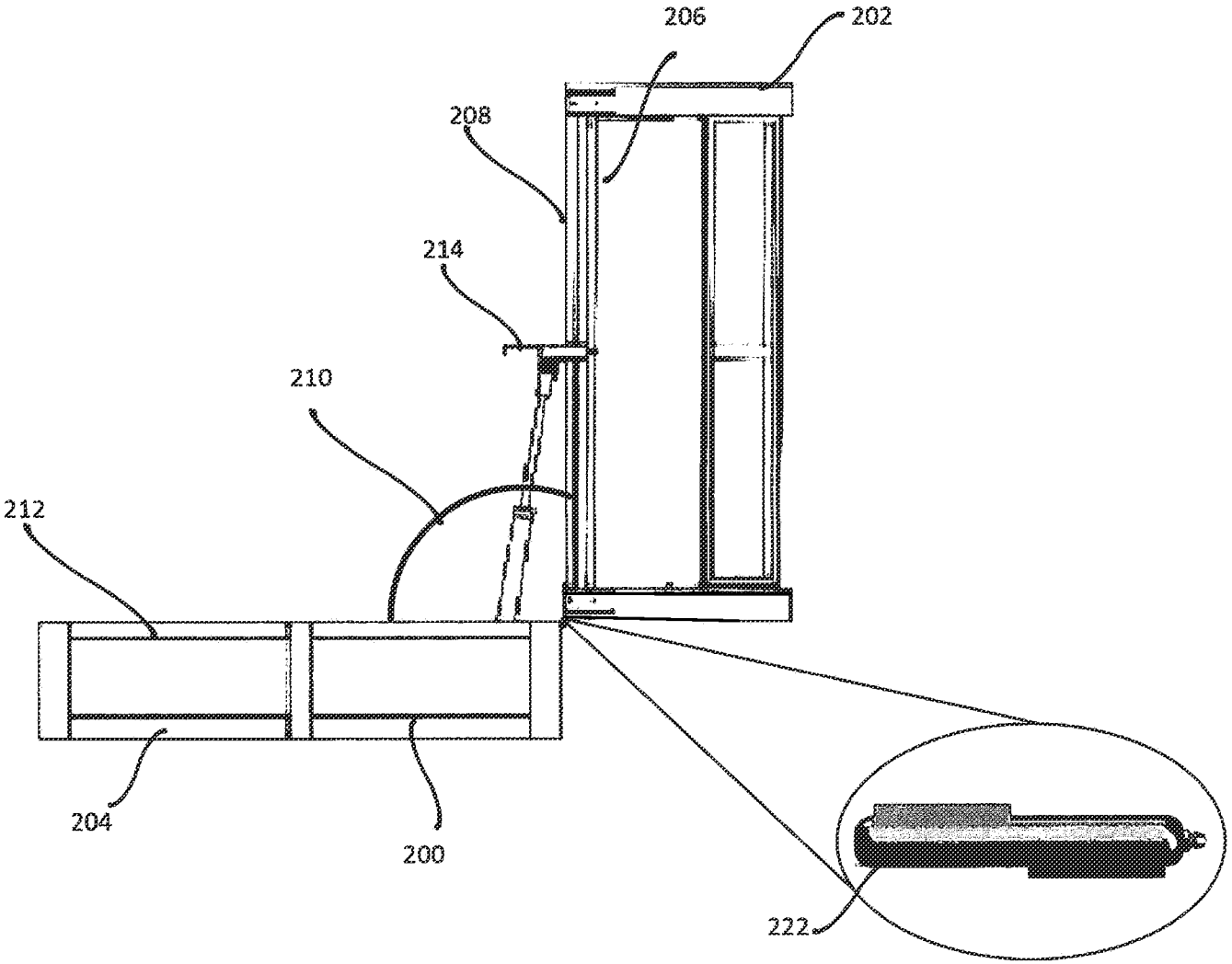
FIG. 2 illustrates another example embodiment of a bed.

Another example embodiment of a bed 200 is shown in FIG. 2. Bed 200 comprises first section 202 and second section 204; which are similar to first section 102 and second section 104 in FIGS. 1A and 1B. As shown in FIG. 2, first section 202 is in an open position. First section 202 comprises first or exterior surface 206, and second or interior surface 208 which are similar to exterior surface 106 and interior surface 108 of FIG. 1B. Second section 202 comprises storage area 212, which is similar to storage area 112 shown in FIG. 1B. Angle of rotation 210 shown in FIG. 2 is similar to angle 110 shown in FIG. 1B. In the example embodiment shown in FIG. 2, second surface 208 acts as a lid to cover storage area 212.

In some embodiments, the bed further comprises a sectional rotating mechanism. The sectional rotating mechanism rotates the first section such as first section 102 or first section 202 about the hinge mechanism between a closed position and an open position, and vice-versa. An example of a hinge 222 which is part of a hinge mechanism is shown in FIG. 2. When the first section is rotated from a closed position, the storage area is exposed so that a user can access the storage area.

The sectional rotating mechanism is implemented using techniques known to those of skilled in the art, such as one or more of electric motors, pneumatics, hydraulics, linear actuators. Examples of such sectional rotating mechanisms are linear actuator 214 shown in FIG. 2; and actuator 656 for the example embodiment of a bed 600 shown in FIG. 6. As will be explained below, the operation of the sectional rotating mechanism is controlled by a sectional rotating mechanism control unit. In some embodiments, the sectional rotating mechanism control unit also controls the movement of the at least one of the one or more contents in the storage area. In some embodiments, this is achieved by the sectional rotating mechanism control unit controlling the movement of the one or more physical organizing elements as discussed above.

In some embodiments, there is a ballistic shield which is rotatable. Then when the first section is rotated from closed to open position, the ballistic shield can also be rotated to an open position to enable a user to take cover. An example embodiment is shown in FIG. 1B, where the ballistic shield 162 rotates together with the first section 102 but is not integrated into the first section 102. In embodiments where second section 104 is also made bullet proof or bullet resistant, a user can then take cover behind the combination of ballistic shield 162 and second section 104.

Figure 4:
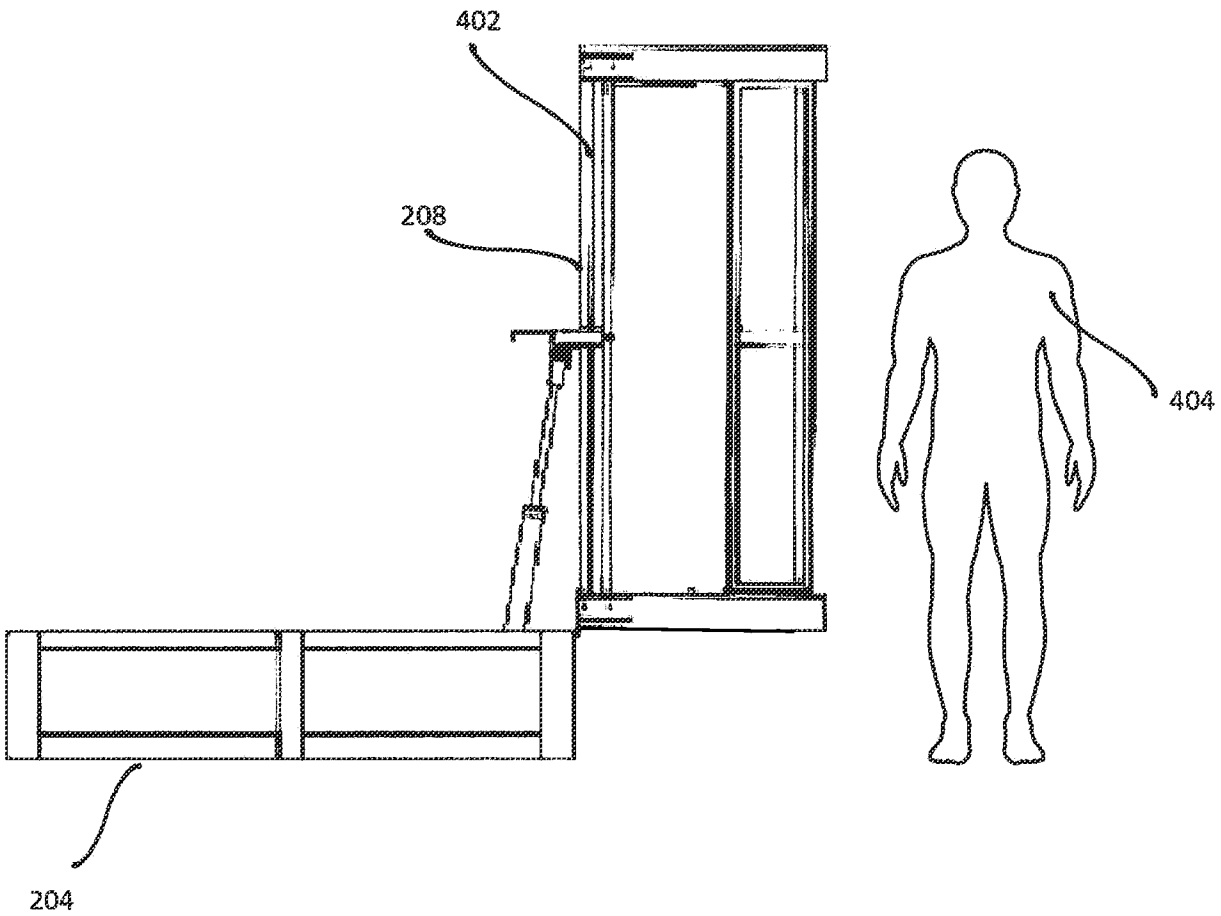
FIG. 4 illustrates an example embodiment of a bed with a ballistic shield.

Another example embodiment of a ballistic shield is shown in FIG. 4, using the example embodiment of bed 200 from FIG. 2. In the embodiment shown in FIG. 4 some part of the second surface 208 comprises a ballistic shield 402, that is, the ballistic shield is integrated into the first section. Then, as shown in FIG. 4, in the embodiments where second section 204 is made bullet proof or bullet resistant, one or more users such as user 404 can take cover behind the combination of ballistic shield 402 and second section 104, and is not restricted to a prone position.

In some of the embodiments where the ballistic shield is not integrated into the first section, the rotation of the ballistic shield is controlled by the sectional rotating mechanism control unit.

Figure 5:
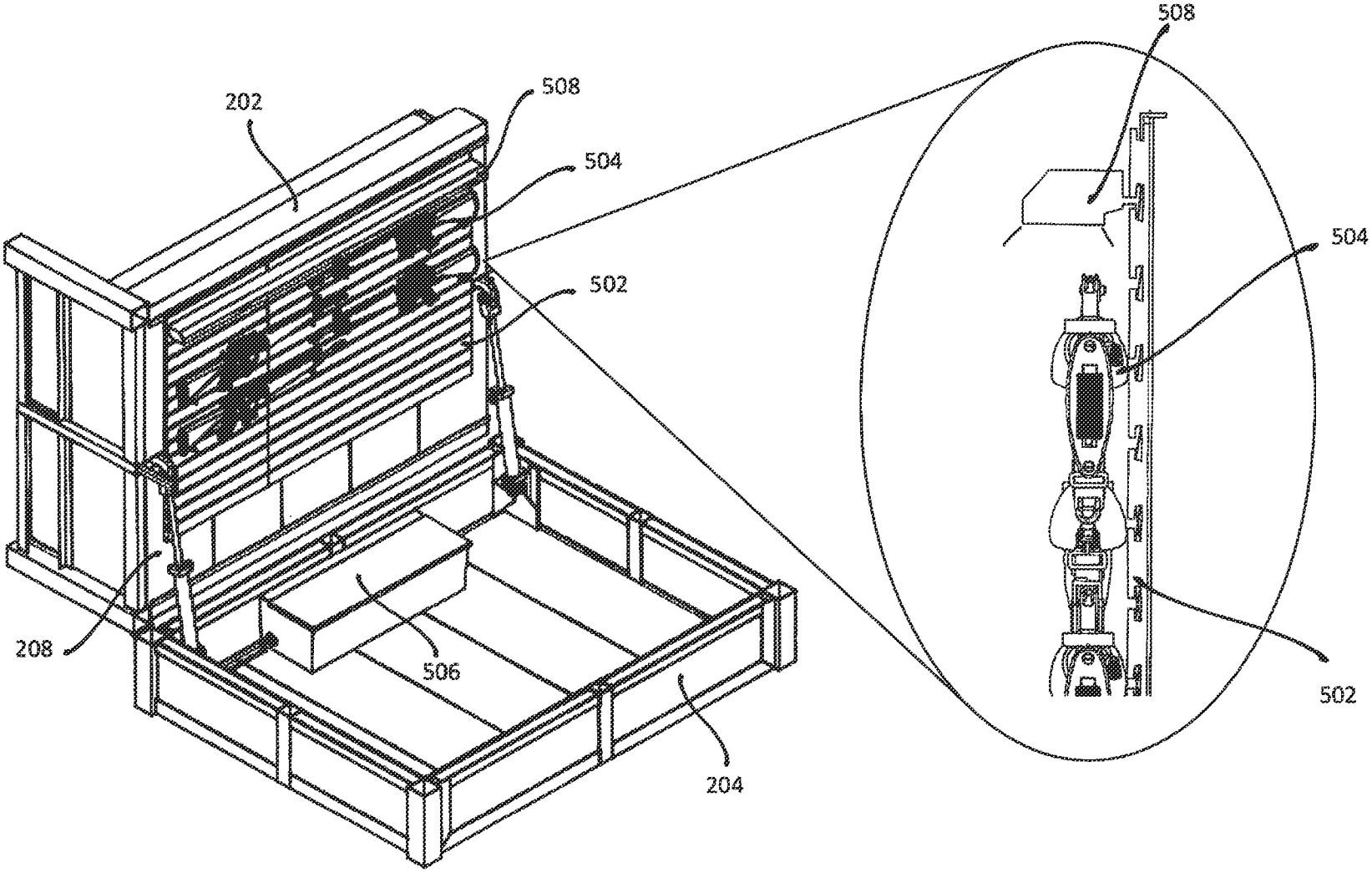
FIG. 5 illustrates an example embodiment of a bed where one or more of the contents of the storage area are mounted to a second surface of the first section.

In some embodiments, one or more of the contents of the storage area are mounted to the second surface of the first section. Then, when the rotating is complete, these items are accessible to the user. An example embodiment is shown in FIG. 5. In FIG. 5, items such as rifle 504 is mounted on second surface 208 of first section 202 by way of mounting element 502.

As previously explained, in some embodiments, the storage area comprises one or more physical organizing elements for organization; and better presentation and access for a user. A further example of this is shown in FIG. 5. Storage area 212 comprises box 506, which is an example of a physical organizing element.

In some embodiments, either the first section or the storage area comprises at least one lighting subsystem to illuminate the storage area or items mounted on the second surface of the first section. The at least one lighting subsystem comprises, for example, a set of spotlights, fluorescent lights, light emitting diodes or other suitable lighting devices. In some embodiments, the lighting subsystem is switched on either

- while the rotating of the first section from the closed position to the open position is performed, or
- when the rotating from the closed position to the open position is completed.

An example embodiment of a lighting subsystem is lighting element 508 attached to the second surface 208 in FIG. 5 to illuminate items such as rifles 504 mounted using mounting element 502. A detailed side view is also shown in FIG. 5.

In some embodiments, the lighting subsystem is controlled by a lighting subsystem control unit, which will be explained in further detail below.

In some embodiments, the first section comprises a constraining mechanism. Then, either before rotation of the first section commences or while rotation of the first section is taking place, the constraining mechanism is employed to hold the one or more items of bedding in place, and thereby constrain the one or more items of bedding to lie on the first surface while the first section is rotated to the open position. In some embodiments, the constraining mechanism is controlled using a constraining mechanism control unit, which will be explained in further detail below.

Example embodiments of this constraining mechanism are now described with reference to FIG. 1A and example embodiment of bed 600 in FIG. 6.

As explained previously, headboard 152 and footboard 154 in FIG. 1A form part of a constraining mechanism. In FIG. 6, panels 652 and 654 are part of the constraining mechanism.

In some embodiments, the constraining mechanism comprises at least one of one or more headboards such as headboard 152 of FIG. 1A. In some embodiments the one or more headboards comprise a set of one or more panels such as panel 652 of FIG. 6. The one or more panels rotate between a first head position and a second head position. When the one or more panels are in the second head position, the one or more items of bedding are secured to the first surface. Examples of this are shown in FIG. 6, where panel 652 is in the second head position to secure one or more items of bedding 621 to the first surface of the first section of bed 600.

In some embodiments, the constraining mechanism comprises at least one of one or more footboards such as footboard 154 of FIG. 1A. In some embodiments, the one or more footboards comprise a set of one or more panels such as panel 654. The one or more panels rotate between a first foot position and a second foot position. When the one or more panels are in the second foot position, the one or more items of bedding are secured to the first surface. Examples of this are shown in FIG. 6, where panel 654 is in the second foot position to secure one or more items of bedding 621 to the first surface of the first section of bed 600.

In some embodiments, the rotating between the first and second head position; and the first and second foot position; are performed using one or more positional rotating mechanisms. Examples of positional rotating mechanisms comprise one or more of:

- A pneumatic mechanism,
- A hydraulic mechanism,
- A linear actuator,
- One or more electric motors,
- One or more springs,
- One or more cables, or
- One or more gas springs.

In some embodiments, the constraining mechanism control unit comprises a positional rotating mechanism control unit. The positional rotating mechanism control unit controls the operation of the positional rotating mechanism.

In some embodiments, the storage area is protected using a locking mechanism. The locking mechanism functions to restrict access only to authorized persons. In some embodiments, this locking mechanism is implemented using one or more mechanical locking mechanisms. In other embodiments, the locking mechanism is implemented using one or more electrical locking mechanisms. In yet other embodiments, the locking mechanism is implemented using one or more hydraulic locking mechanisms. In yet other embodiments, the locking mechanism is implemented using combinations of above mentioned electrical, mechanical or hydraulic locking mechanisms.

The locking mechanism can be either locked or unlocked. In some embodiments, the locking and unlocking are performed by a locking mechanism control unit, which will be described further below.

Locking and unlocking are performed by a user using, for example, at least one input device. The input devices will be further explained below. Then examples of techniques to lock and unlock include, but are not limited to:

- A key;
- Entry of a numeric or alphanumeric combination on a keypad, a keyboard or a touchscreen;
- Entering a combination into a combination lock;
- A radio frequency identification (RFID)-based technique utilizing a suitable RFID-enabled input device;
- An application running on an input device 809 such as a smartphone, tablet, laptop, or smartwatch;
- A voice command accepted from an input device 809 such as a microphone;
- A near field communications (NFC)-based technique utilizing a suitable NFC-enabled input device; and
- A biometric technique such as a fingerprint or retina scan, using an input device 809 which accepts biometric inputs;

In some embodiments, the locking mechanism is engaged when the first section is in the closed position. This prevents unauthorized persons from accessing the storage area. In some embodiments where the locking mechanism is engaged in the closed position, prior to the first section being rotated to the open position, the locking mechanism needs to be unlocked. This is achieved using one or more of the above-described techniques.

In some embodiments, the locking mechanisms comprise a first set of mechanisms integrated into the sectional rotating mechanism, for example, into the hydraulic mechanisms or linear actuators comprising the sectional rotating mechanism. In other embodiments, the locking mechanisms comprise a second set of mechanisms separate from the sectional rotating mechanism. An example is mechanism 701 shown in FIG. 7. Mechanism 701 is a latch-based mechanism which is inaccessible from outside the bed and is unlocked by electro-mechanical means such as a linear actuator or solenoid.

Figure 6:
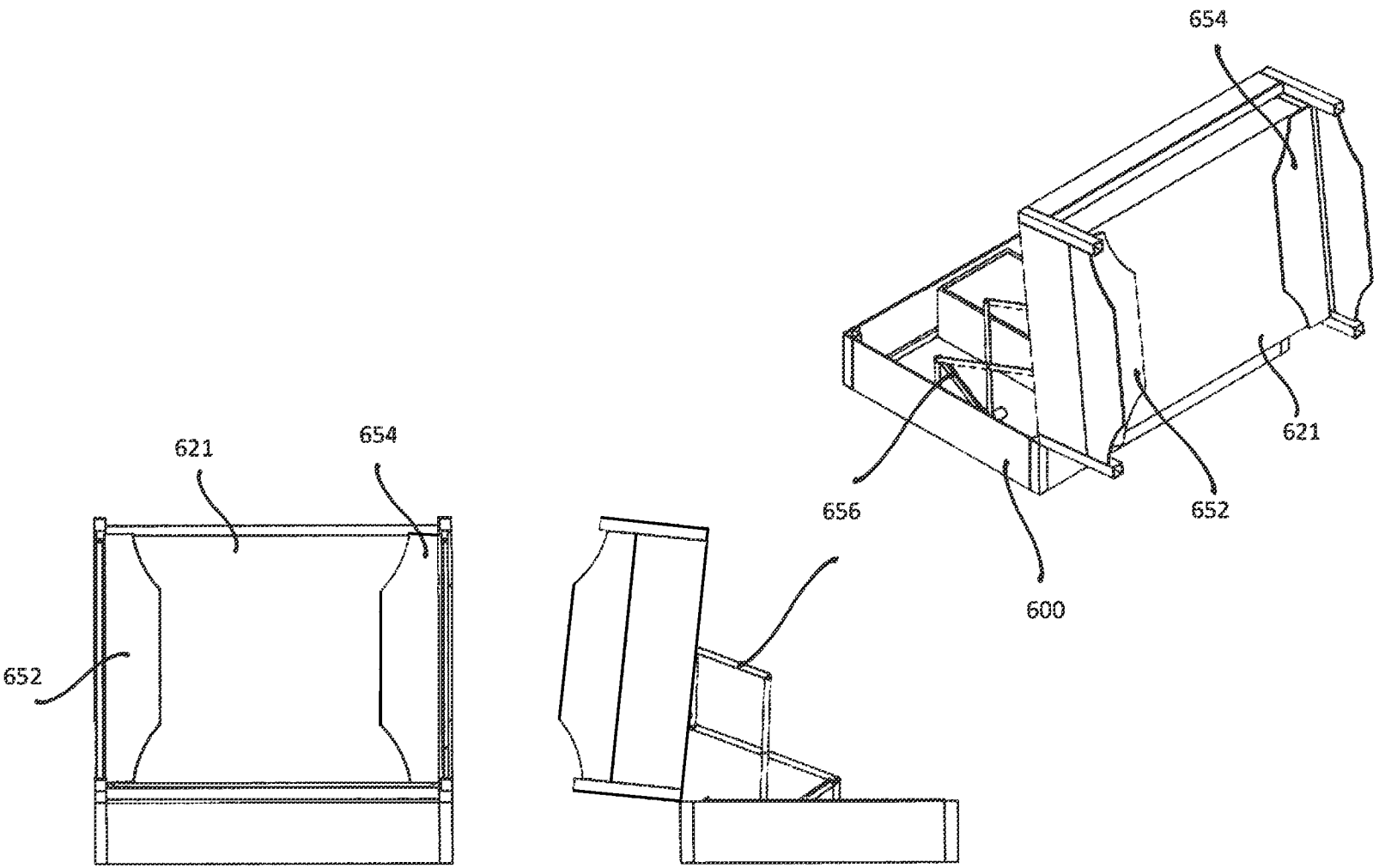
FIG. 6 illustrates an example embodiment of a bed with a constraining mechanism.
Figure 7:
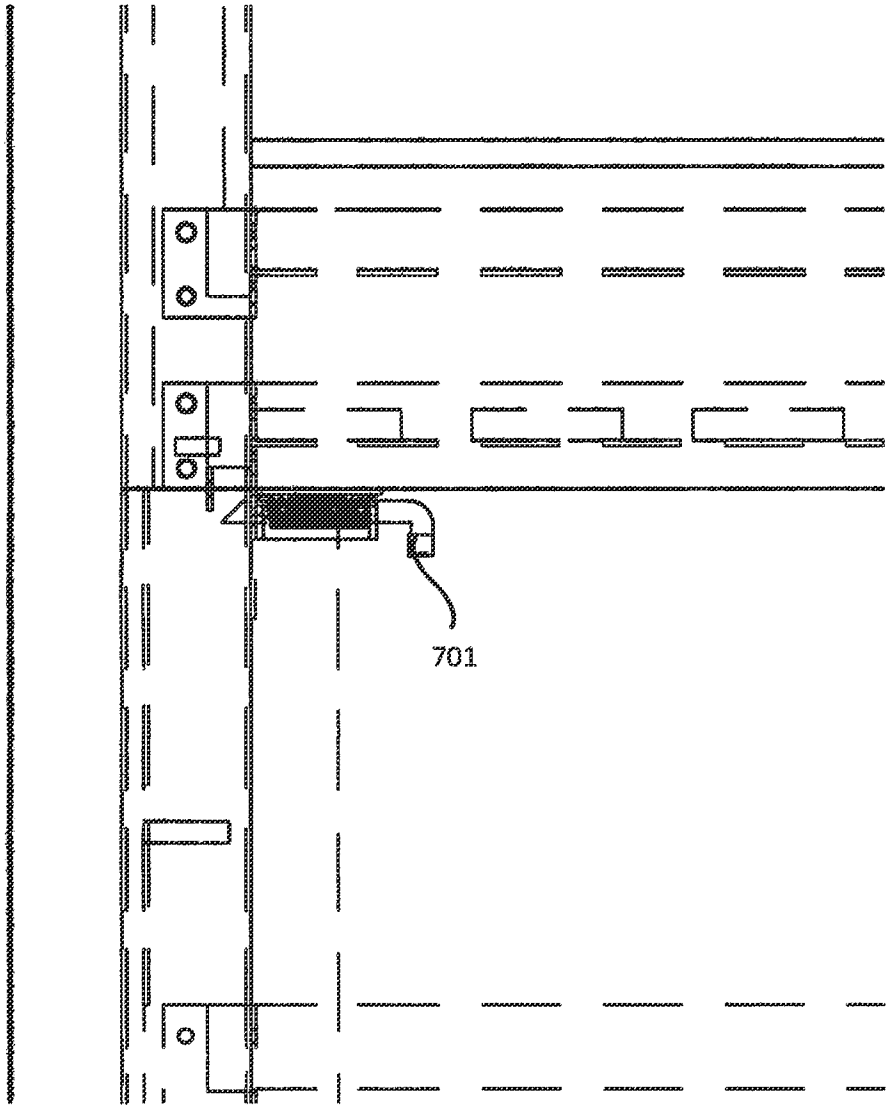
FIG. 7 illustrates an example embodiment of a locking mechanism used in a bed.
Figure 8:
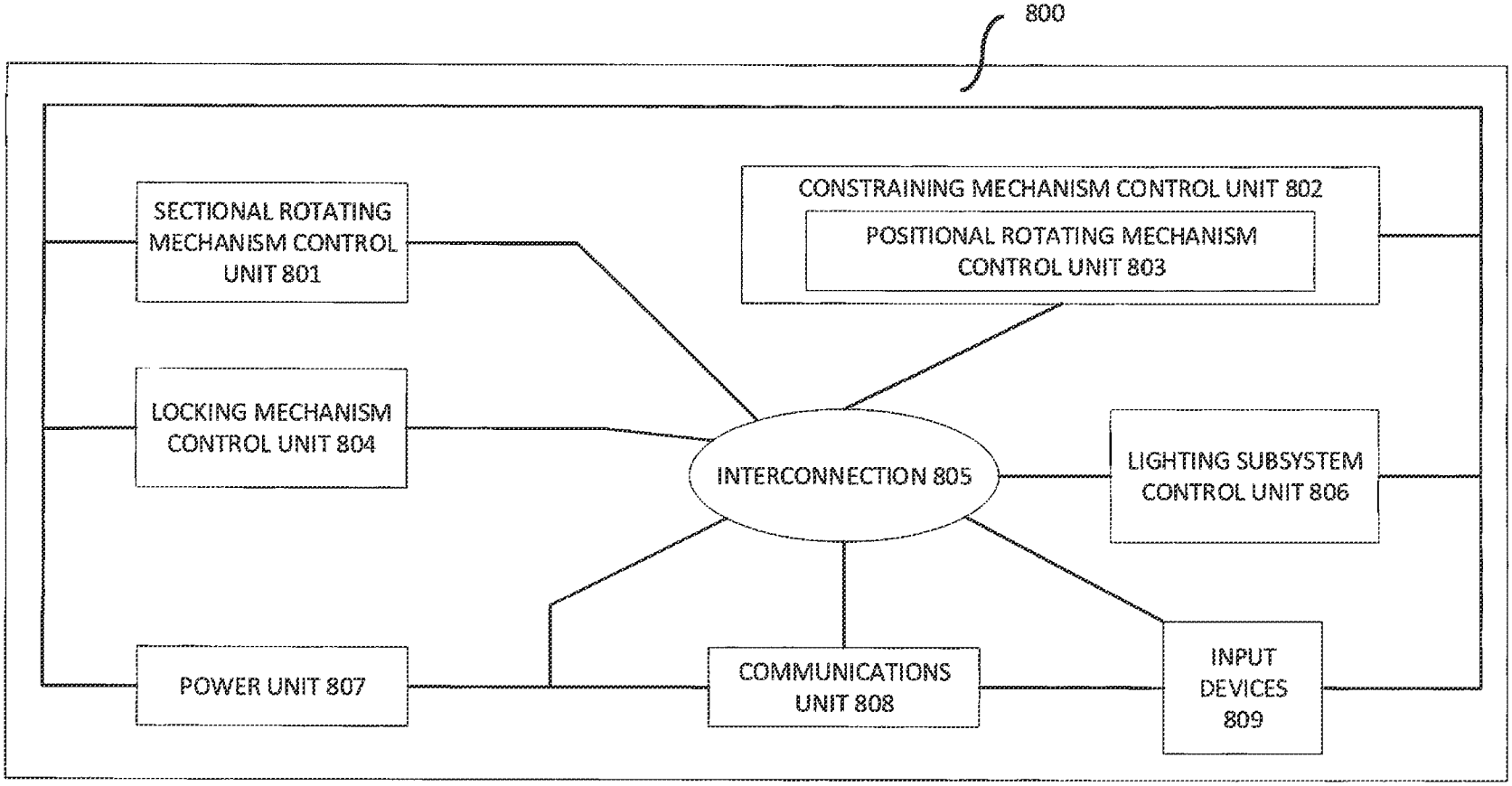
FIG. 8 illustrates an example embodiment of a control and power subsystem to control the operation of a bed.

FIG. 8 shows an example embodiment of a control and power subsystem 800 to control the operation of a bed such as bed 100 of FIG. 1A, bed 200 of FIG. 2, bed 300 of FIG. 3 and bed 600 of FIG. 6. In FIG. 8, as explained above, sectional rotating mechanism control unit 801 controls the operation of a sectional rotating mechanism. In some embodiments, sectional rotating mechanism control unit 801 comprises hardware such as one or more control circuits and devices such as microprocessors, microcontrollers, programmable logic control and processors to control the operation of a sectional rotating mechanism using techniques known to those of skill in the art. Additionally, as explained above, in some embodiments, the sectional rotating mechanism control unit 801 controls the movement of the one or more contents in the storage area by, for example, controlling the movement of the physical organizing elements located in the storage area. As explained above as well, in some of the embodiments where a ballistic shield is not integrated into the first section, the rotation of the ballistic shield is controlled by the sectional rotating mechanism control unit 801. In other embodiments, sectional rotating mechanism control unit 801 is implemented using software. In yet other embodiments, sectional rotating mechanism control unit 801 is implemented using a combination of hardware and software.

Constraining mechanism control unit 802 controls the operation of a constraining mechanism. In some embodiments, constraining mechanism control unit 802 comprises, for example, hardware such as one or more control circuits and devices such as microprocessors, microcontrollers, programmable logic control and processors to control the operation of the constraining mechanism using techniques known to those of skill in the art. In other embodiments, constraining mechanism control unit 802 is implemented using software. In yet other embodiments, constraining mechanism control unit 802 is implemented using a combination of hardware and software.

In some embodiments, constraining mechanism control unit 802 comprises a positional rotating mechanism control unit 803, as explained above. Positional rotating mechanism control unit 803 controls the rotation of one or more positional rotating mechanisms as described above. In some embodiments, positional rotating mechanism control unit 803 comprises, for example, hardware such as one or more control circuits and devices such as microprocessors, microcontrollers, programmable logic control and processors to control the operation of the positional rotating mechanism using techniques known to those of skill in the art. In other embodiments, positional rotating mechanism control unit 803 is implemented using software. In yet other embodiments, positional rotating mechanism control unit 803 is implemented using a combination of hardware and software.

Locking mechanism control unit 804 controls the operation of the previously described locking mechanism, as explained above. In some embodiments, locking mechanism control unit 804 is part of sectional rotating mechanism control unit 801. In some embodiments, locking mechanism control unit 804 comprises hardware, for example, one or more control circuits and devices such as microprocessors, microcontrollers, programmable logic control and processors to control the operation of the locking mechanism using techniques known to those of skill in the art. In other embodiments, locking mechanism control unit 804 is implemented using software. In yet other embodiments, locking mechanism control unit 804 is implemented using a combination of hardware and software.

Interconnection 805 communicatively couples the components of control and power subsystem 800 together. Interconnection 805 comprises, for example, cables, connectors, transmitters and receivers to enable components of subsystem 800 to communicate with each other using communication protocols known to those of skill in the art. In some embodiments, interconnection 805 enables at least one of wired and wireless communications between components of subsystem 800.

Lighting subsystem control unit 806 controls the operation of the previously described lighting subsystem, as explained above. In some embodiments, lighting subsystem control unit 806 is part of sectional rotating mechanism control unit 801. In some embodiments, lighting subsystem control unit 806 comprises, for example, hardware such as one or more control circuits and devices such as microprocessors, microcontrollers, programmable logic control and processors to control the operation of the lighting subsystem using techniques known to those of skill in the art. In other embodiments, lighting subsystem control unit 806 is implemented using software. In yet other embodiments, lighting subsystem control unit 806 is implemented using a combination of hardware and software.

The power unit 807 is coupled to the other components of subsystem 800 to supply power to these components. In some embodiments, power unit 807 comprises an alternating current (AC) adapter for connection to a mains supply. In some embodiments, power unit 807 comprises one or more batteries. In some embodiments, power unit 807 comprises an AC adapter and one or more batteries.

Communications unit 808 is responsible for receiving data and commands from, and transmitting data and commands to devices external to the bed. In one embodiment, communication unit 808 comprises specialized processors or communications circuitry to enable the operation of various communication protocols. These communications protocols comprise, for example, Bluetooth, Wi-Fi, 5G, LTE or other wired and wireless communications protocols known to those of skill in the art.

Input devices were previously mentioned. In FIG. 8, an example embodiment of input devices 809 is shown. Input devices 809 are devices which allow the user to interact with the bed. In some embodiments, input devices 809 comprise mechanical devices such as keys and pushbuttons. In some embodiments, input devices 809 comprise one or more electronic devices which can be used by a user to input data and commands to the bed. These input devices may be part of the bed, or external to the bed. Examples of input devices include, for example:

- Keys;
- Pushbuttons;
- Magnetic sensors;
- keypads;
- displays;
- touchscreens;
- keyboards;
- RFID-enabled devices;
- NFC-enabled devices;
- devices to receive user voice commands such as microphones;
- devices to convert received user voice commands into commands to be directed to one or more other components of control subsystem 800;

biometric devices such as finger scanners or retina scanners; and smartphones, tablets, laptops, smartwatches and desktops.

In some of the embodiments where input devices 809 are electronic devices, input devices 809 communicate with the rest of the components of subsystem 800 via at least one of communications unit 808 or interconnection 805. In some embodiments where the input devices 809 are external to the bed, then the input device is coupled to the components of subsystem 800 via communications unit 808, as previously described. In some embodiments where the input devices 809 are part of the bed, then the input device is coupled to the components of subsystem 800 via interconnection 805, as previously described.

While FIG. 8 shows a control subsystem 800 comprising a number of components, one of skill in the art would know that this is not the only configuration that is possible. For example, in some embodiments, at least two or more of the components of subsystem 800 are implemented together within one or more processors.

Figure 9:
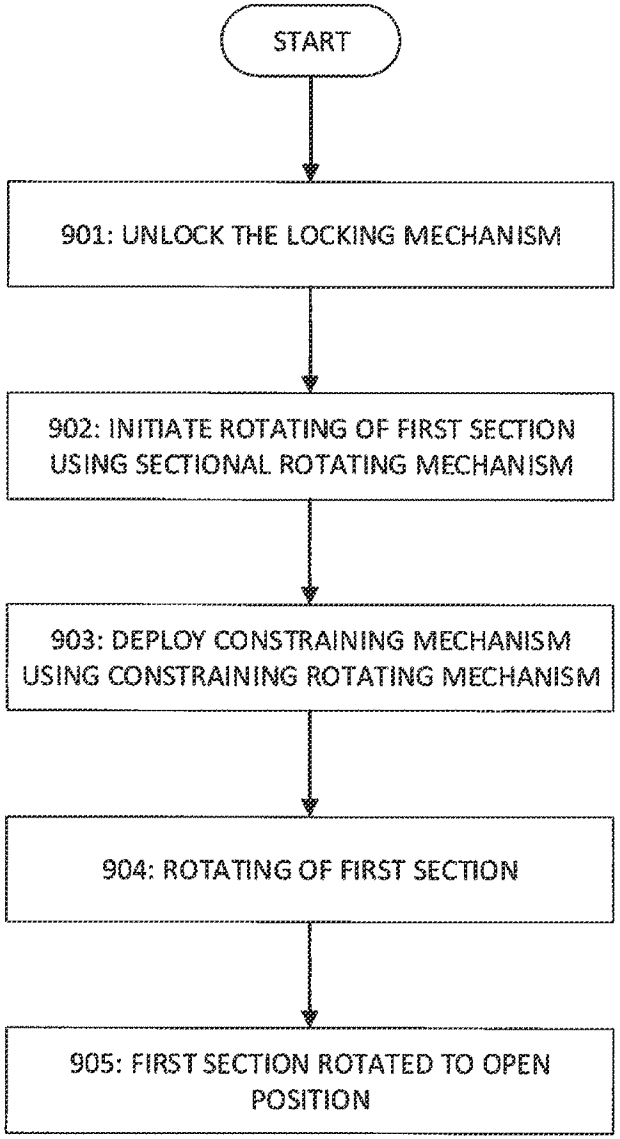
FIG. 9 illustrates an example embodiment of a process of rotating the first section from a closed position to an open position.

A flowchart showing the operation of rotating the first section from a closed position to an open position is described in FIG. 9.

In step 901, the locking mechanism is unlocked by the locking mechanism control unit so that the first section can be rotated. In some embodiments, the unlocking is performed using one of the previously described techniques.

In step 902, the rotating is initiated using the previously described sectional rotating mechanism, which is controlled by the sectional rotating mechanism control unit. In some embodiments, steps 901 and 902 are performed together. In other embodiments, step 901 and step 902 are performed separately. Examples of techniques which can be used to initiate the rotating include using at least one of input devices 809 such as:

A key;

Entry of a numeric or alphanumeric code on an input device 809 such as a keypad, touchscreen or keyboard;

Entering a combination into a combination lock;

An RFID-based technique utilizing a suitable RFID-enabled input device 809;

An application running on an input device 809 such as a smartphone, tablet, laptop, or smartwatch;

A voice command accepted from an input device 809 such as a microphone;

An NFC-based technique utilizing a suitable NFC-enabled input device 809;

A biometric technique using an input device 809 which accepts biometric inputs;

Pushing a pushbutton, or

A magnetic sensor.

In some embodiments, utilizing one of the above-mentioned techniques generates one or more commands which are directed to the sectional rotating mechanism control unit 801 via interconnection 805. The sectional rotating mechanism control unit 801 converts the received commands into signals to control the sectional rotating mechanism to initiate rotating. In some embodiments where the input device is external to the bed, the input device is coupled to the components of subsystem 800 via communications unit 808, and the commands are received by communications unit 808 and then transmitted to sectional rotating mechanism control unit 801 via interconnection 805.

In step 903, the constraining mechanism is deployed to constrain the one or more items of bedding to lie flat on the first surface of the first section, after initiation of the rotating in step 902. In some embodiments, after the command to initiate rotating is received, the sectional rotating mechanism control unit 801 communicates with the constraining mechanism control unit 802 via interconnection 805 to deploy the constraining mechanism. In some embodiments, the deploying of the constraining mechanism comprises using the one or more positional rotating mechanisms as discussed above. As explained previously, the one or more positional rotating mechanisms are controlled by the positional rotating mechanism control unit.

In step 904, the sectional rotating mechanism rotates the first section to an open position, under the control of sectional rotating mechanism control unit 801. In some embodiments, the step 903 occurs prior to step 904. In other embodiments, steps 903 and 904 take place simultaneously, that is, the constraining mechanism is deployed while the first section is rotating. In these embodiments, the constraining mechanism is deployed before the angle of rotation such as angle 110 of FIG. 1B or angle 210 of FIG. 2 reaches a threshold value.

The threshold value is set by, for example constraining mechanism control unit 802 depending on one or more factors. Examples of the one of more factors comprise:

weight of the one or more items of bedding, and coefficients of friction between the one or more items of bedding and the first surface.

In some embodiments, the threshold value is configured based on simulations or experimentation. In some embodiments, the user or an installation technician configures the threshold value using an input device 809 to send commands to constraining mechanism control unit 802 via communications unit 808 or interconnection 805. In some embodiments, the input device 809 is a device such as a smartphone or tablet running an application, and the application allows the user to configure the threshold setting. In some embodiments, the threshold value is reconfigurable so that if changes to, for example, the one or more items of bedding occur, the constraining mechanism is still deployed as needed.

In step 905, the rotating is complete, and the first section is in an open position. The bedding is secured to the first surface.

Variations to the above process are also possible. For example, as previously described, the lighting subsystem is switched on either while the rotating of the first section is performed or when the rotating is completed. Then, for example, as part of steps 904 or 905, the sectional rotating mechanism control unit 801 sends commands or signals to lighting subsystem control unit 806 via interconnection 805 to switch on the lighting subsystem. In some embodiments, this step is performed as a separate step. In some embodiments, this step is performed by the user via input devices 809.

Also, as previously described, in some embodiments there is a ballistic shield which is not integrated into the first section, and the rotation of the ballistic shield is controlled by the sectional rotating mechanism control unit. In some embodiments, this step is performed as part of steps 904 or 905. In some embodiments, this step is performed as a separate step. In some embodiments, this step is performed by the user via input devices 809.

As previously described, in some embodiments at least one of the one or more contents in the storage area are moved either during or after the rotating of the first section, to ensure easier access and better presentation to a user. In some embodiments, this is achieved by moving one or more of the physical organizing elements. As previously described, the sectional rotating mechanism control unit facilitates this. In some embodiments, this step is performed as part of steps 904 or 905. In some embodiments, this step is performed as a separate step. In some embodiments, this step is performed by the user via input devices 809.

For the first section to rotate back to the closed position, the user initiates this process using similar mechanisms to that used to rotate the first section to the open position. As would be known to one of skill in the art, the reverse of the above process is performed. Then the constraining mechanism stops being deployed either when the rotation ends or when the angle of rotation is below a threshold value, similar to as previously explained.

The above-described embodiments resolve the problems faced in Adrain and BEDBUNKER. The combination of the constraining mechanism, sectional rotating mechanism and the control and power subsystem allow for easier and more convenient access of the storage area in an automated fashion. The above-described embodiments also allow the deployment of a ballistic shield which allows a user to take cover in both prone and positions other than prone positions, for example, standing upright or crouching.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method for a bed, wherein
the bed comprises a first section and a second section coupled to each other via a hinge mechanism,
the first section comprises
a first surface, wherein one or more items of bedding lie on the first surface, and
a constraining mechanism comprising:
one or more headboards comprising a first one or more panels, wherein:
the first one or more panels rotate between a first head position and a second head position, and
one or more footboards comprising a second one or more panels, wherein:
the second one or more panels rotate between a first foot position and a second foot position, and
the second section comprises a storage area,
the method comprising:
rotating the first section about the hinge mechanism from a closed position to an open position; and
constraining, by the constraining mechanism, the one or more items of bedding to lie on the first surface during the rotating of the first section, wherein the constraining by the constraining mechanism further comprises:
the first one or more panels rotating from the first head position to the second head position,
the second one or more panels rotating from the first foot position to the second foot position, and
the rotating of the first one or more panels and the second one or more panels is performed to hold the one or more items of bedding to the first surface.

2. The method of claim 1, further comprising initiating the rotating of the first section using one of:
a key;
a keypad, keyboard or touchscreen;
a combination lock;
a radio frequency identification (RFID)-based technique,
an application running on an input device,
a voice command,
a near field communications (NFC)-based technique,
a pushbutton, or
a magnetic sensor.

3. The method of claim 1, wherein
the storage area stores one or more contents; and
the method further comprises moving one of the one or more contents either during or after the rotating of the first section is performed.

4. The method of claim 1, wherein the storage area is fire resistant or fire proof.

5. The method of claim 1, wherein
the storage area is protected using a locking mechanism; and
the method further comprises unlocking the locking mechanism using one of
a key,
a numeric or alphanumeric combination,
an RFID-based technique,
an application running on an input device,
a voice command,
an NFC-based technique, and
a biometric technique.

6. The method of claim 5, wherein the storage area stores firearms and ammunition.

7. The method of claim 1, wherein the constraining is performed using one or more of:
a pneumatic mechanism,
a hydraulic mechanism,
a linear actuator,
an electric motor
a spring,
a cable, or
a gas spring.

8. The method of claim 1, wherein:
the first section comprises a second surface;
the method further comprises:
performing at least one of:
mounting one or more items on the second surface, or
storing one or more contents in the storage area; and
illuminating, using at least one lighting subsystem, at least one of:
the one or more items mounted on the second surface, or
the storage area.

9. The method of claim 8, comprising switching on the at least one lighting subsystem:
either while the rotating of the first section from the closed position to the open position is performed, or
when the rotating of the first section from the closed position to the open position is completed.

10. A system for a bed, wherein the bed comprises
a first section and a second section coupled to each other via a hinge mechanism,
the first section comprises
a first surface, wherein one or more items of bedding lie on the first surface, and
a constraining mechanism controlled by a constraining mechanism control unit, wherein the constraining mechanism comprises:
one or more headboards comprising a first one or more panels, wherein the first one or more panels rotate between a first head position and a second head position, and one or more footboards comprising a second one or more panels, wherein the second one or more panels rotate between a first foot position and a second foot position;

the second section comprises a storage area, and a sectional rotating mechanism to rotate the first section about the hinge mechanism between a closed position and an open position, wherein the sectional rotating mechanism is controlled by a sectional rotating mechanism control unit, and the sectional rotating mechanism control unit is communicatively coupled to the constraining mechanism control unit via one or more interconnections, wherein when the first section is rotated to the open position from the closed position, the constraining mechanism is controlled by the constraining mechanism control unit to constrain the one or more items of bedding to lie on the first surface during the rotating of the first section, wherein the constraining by the constraining mechanism of the one or more items of bedding comprises:

the first one or more panels rotating from the first head position to the second head position to hold the one or more items of bedding to the first surface, the second one or more panels rotating from the first foot position to the second foot position, and the rotating of the first one or more panels and the second one or more panels performed to hold the one or more items of bedding to the first surface.

11. The system of claim 10, further wherein the rotating of the first section is initiated using one of a key;

a keypad, keyboard or touchscreen;

a combination lock;

a radio frequency identification (RFID)-based technique;

an application running on an input device;

a voice command, a near field communications (NFC)-based technique, a pushbutton, or a magnet sensor.

12. The system of claim 10, wherein the storage area stores one or more contents; and the sectional rotating mechanism control unit causes the one or more contents to move either during or after the rotating.

13. The system of claim 10, wherein the bed further comprises a ballistic shield to enable a user to take cover in a position other than a prone position.

14. The system of claim 10, wherein the storage area is protected using a locking mechanism controlled by a locking mechanism control unit; and the locking mechanism is unlocked by the locking mechanism control unit using one of a key, a numeric or alphanumeric combination, an RFID-based technique, an application running on an input device, a voice command, an NFC-based technique, and a biometric technique.

15. The system of claim 14, wherein the storage area is bullet resistant or bullet proof.

16. The system of claim 10, wherein the constraining mechanism comprises one or more of:

a pneumatic mechanism, a hydraulic mechanism, a linear actuator, an electric motor, a spring, a cable, or a gas spring.

17. The system of claim 10, wherein either the first section or the storage area comprises a at least one lighting subsystem.

18. The system of claim 17, wherein the at least one lighting subsystem comprises at least one of:

one or more spotlights, one or more fluorescent lights, or one or more light emitting diodes.

19. The system of claim 17, wherein:

the first section comprises a second surface;

the system further comprising:

at least one of:

one or more items mounted on the second surface, or the storage area storing one or more contents; and the at least one lighting subsystem illuminates the at least one of:

one or more items mounted on the second surface, or the storage area storing one or more contents.

20. The system of claim 10, wherein the first section comprises a second surface, and one or more items are mounted on the second surface.

* * * * *